US006779883B1

(12) United States Patent
Onishi et al.

(10) Patent No.: US 6,779,883 B1
(45) Date of Patent: Aug. 24, 2004

(54) OVERCOATING DEVICE AND INK JET RECORDING APPARATUS WITH THE OVERCOATING DEVICE

(75) Inventors: Hiroyuki Onishi, Nagano (JP); Katsumori Takei, Nagano (JP); Hajime Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/351,952

(22) Filed: Jan. 27, 2003

(30) Foreign Application Priority Data

Jan. 28, 2002 (JP) ..... P2002-019172
Jan. 22, 2003 (JP) ..... P2003-014084

(51) Int. Cl.[7] ..... B41J 2/01
(52) U.S. Cl. ..... 347/101
(58) Field of Search ..... 347/2, 101–104; 156/349, 362

(56) References Cited

U.S. PATENT DOCUMENTS 6,585,366 B2 * 7/2003 Nagata et al. ..... 347/101
2003/0085977 A1 * 5/2003 Shibasaki ..... 347/104

* cited by examiner

*Primary Examiner*—Michael S. Brooke
(74) *Attorney, Agent, or Firm*—Ladas & Parry

(57) ABSTRACT

An overcoating device can transport a plurality of recorded materials in parallel with spacing and includes a transfer sheet supply unit for supplying a transfer sheet having a transferred layer having a width capable of covering the recorded materials on a support onto the recorded materials, a heating and pressing unit made up of a pair of pressing members, and a stripping unit for stripping the support. When the recorded materials and the transfer sheet pass through the heating and pressing unit, the portion of the transferred layer corresponding to the spacing does not come in contact with the pressing member.

6 Claims, 4 Drawing Sheets

OVERCOATING DEVICE AND INK JET RECORDING APPARATUS WITH THE OVERCOATING DEVICE

This application for patent is based on Japan patent application Nos. 2002-19172 and 2003-14084, the contents of which are taken in as references.

BACKGROUND OF THE INVENTION

1. Field of the Invention

This invention relates to an overcoating device for overcoating an image face of a recorded material on which an image is formed according to an ink jet method with a protective layer for protecting the image and an ink jet record apparatus having the overcoating device.

2. Description of Related Arts

The ink jet method is a record method of ejecting ink droplets from a nozzle of a record head (ink jet head) and depositing the ink droplets on a record medium of paper, etc., for forming an image. With the recent innovative development of the ink jet record technology, the image quality has reached a high level equivalent to a film photo, but the real image solidity is inferior to that of a film photo. In recent years, improvement in the image solidity has become increasingly valued with expansion of the ink jet record technology to digital photo service, commercial print application, etc.

Known as a record technique capable of enhancing image solidity, gloss, etc., is a thermal transfer overcoating treatment of thermally transferring a transparent film of an image protection film (transfer sheet) having the transparent film on a support onto an image face formed with an image, thereby coating the image with the transparent film (protective layer). Attention is also focused on the thermal transfer overcoating treatment in the ink jet record field as a technique having the potential for accomplishing high image quality and high image solidity equivalent to a film photo, and various improvement techniques concerning the material, composition, formation method, etc., of the protective layer are proposed (for example, JP-A-60-189486, JP-A-2000-52637, and JP-A-2000-233474). JP-A-2000-153677 discloses an ink jet printer including a transfer unit for forming a protective layer for forming a protective layer on an ink jet image face by the transfer unit.

However, to perform the above-described thermal transfer overcoating treatment after ink jet record, a film transfer unit becomes necessary aside from the units required for ink jet record, such as a record head, and therefore there is a problem of dramatically increasing the print cost.

SUMMARY OF THE INVENTION

It is therefore an object of the invention to provide an overcoating device capable of efficiently applying an overcoating treatment to an image face of a recorded material formed with an image according to an ink jet method and providing a recorded material having high image quality and high image solidity comparative to a film photo at low cost and an ink jet record apparatus including the overcoating device.

To the end, according to the invention, there is provided an overcoating device for transporting a plurality of recorded materials formed with images according to an ink jet method in parallel with spacing and overcoating each of image faces of the recorded materials with a protective layer for protecting the image, the overcoating device including a transfer sheet supply unit for supplying a transfer sheet having a transferred layer having a width capable of covering the recorded materials on a support onto the recorded materials transported in parallel with the spacing so as to cover the image faces of the recorded materials; a heating and pressing unit for heating and pressing the recorded materials and the transfer sheet; and a stripping unit for stripping the support from the transfer sheet after heating and pressing, wherein the heating and pressing unit includes a pair of pressing members for allowing the recorded materials and the transfer sheet to pass through a nip part between the paired pressing members and when the recorded materials and the transfer sheet pass through the nip part, the portion of the transferred layer of the transfer sheet corresponding to the spacing does not come in contact with the pressing member coming in contact with the recorded materials, of the pressing member pair.

According to the invention, there is provided an ink jet record apparatus including the above-described overcoating device, wherein a plurality of record media are transported in parallel with spacing and ink is ejected from a plurality of record heads for forming images on the plurality of record media to prepare recorded materials, and then the overcoating device overcoats each of image faces of the recorded materials with a protective layer for protecting the image. That is, the ink jet record apparatus of the invention includes an ink jet record section for transporting a plurality of record media in parallel with spacing and ejecting ink from a plurality of record heads for forming images on the record media and a protective layer formation section for simultaneously forming protective layers on the images; the protective layer formation section is implemented as the above-described coater.

According to the overcoating device of the invention, a plurality of recorded materials are transported in parallel with spacing and at the heating and pressing treatment time, the transferred layer of the transfer sheet does not come in contact with the pressing member of a roller, etc., so that an overcoating treatment can be applied collectively to the recorded materials without depositing the transferred layer on the surface of the pressing member, and the recorded materials each with a protective layer having high image quality and high image solidity comparative to a film photo can be manufactured efficiently at low cost. Since the transferred layer is not deposited on the surface of the pressing member after the heating and pressing treatment, the overcoating device of the invention can lighten cleaning work of the surface of the pressing member, etc., and is excellent in maintainability. The ink jet record apparatus of the invention can manufacture the recorded materials each with the protective layer in one pass, so that the manufacturing work becomes still more efficient.

DETAILED DESCRIPTION OF THE PREFERRED EMBODIMENTS

Referring now to the accompanying drawings, there are shown preferred embodiments of an overcoating device and an ink jet record apparatus including the overcoating device according to the invention.

Figure 1:
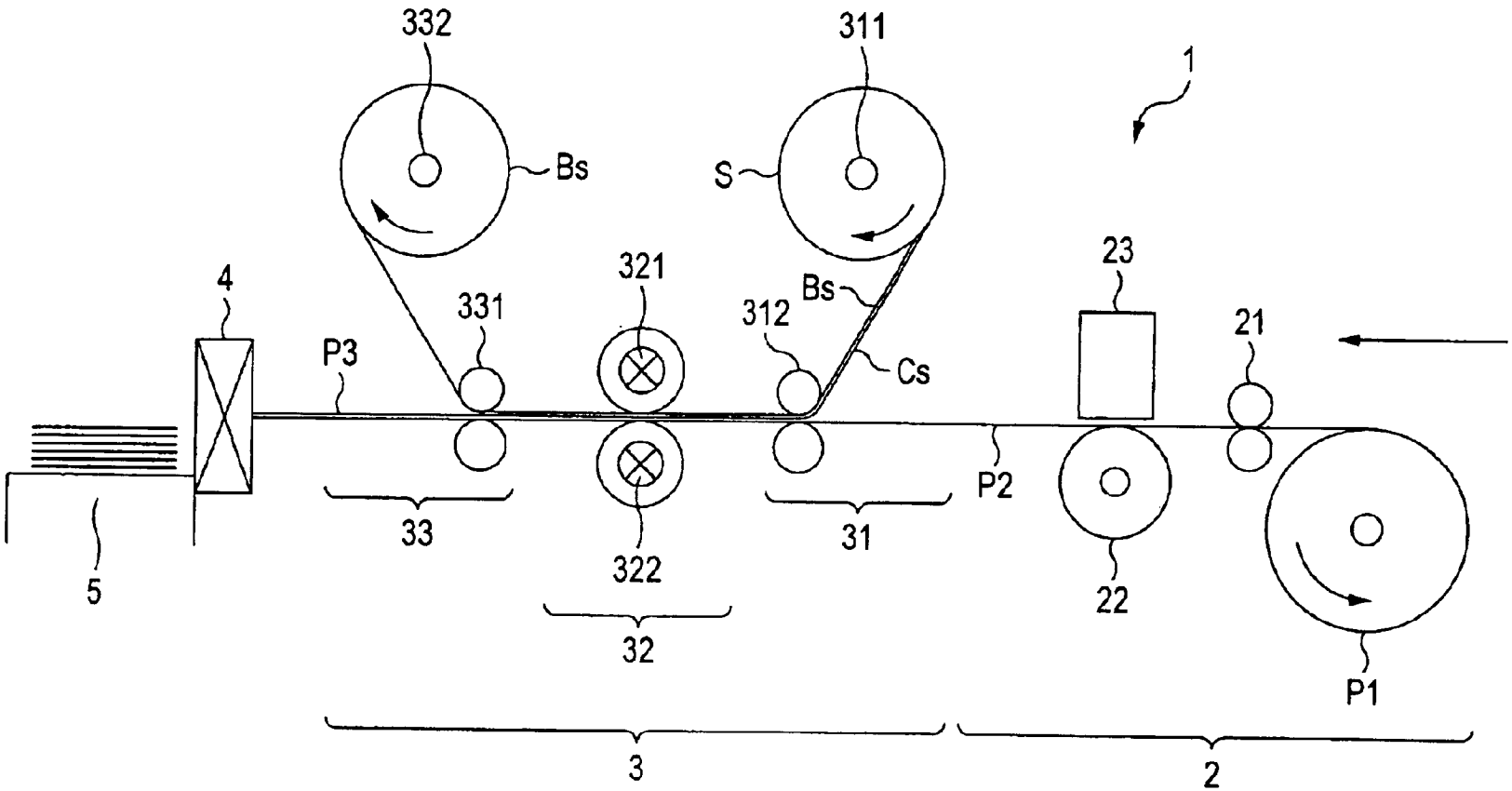
FIG. 1 is a schematic side view of an ink jet record apparatus of an embodiment of the invention.
Figure 2:
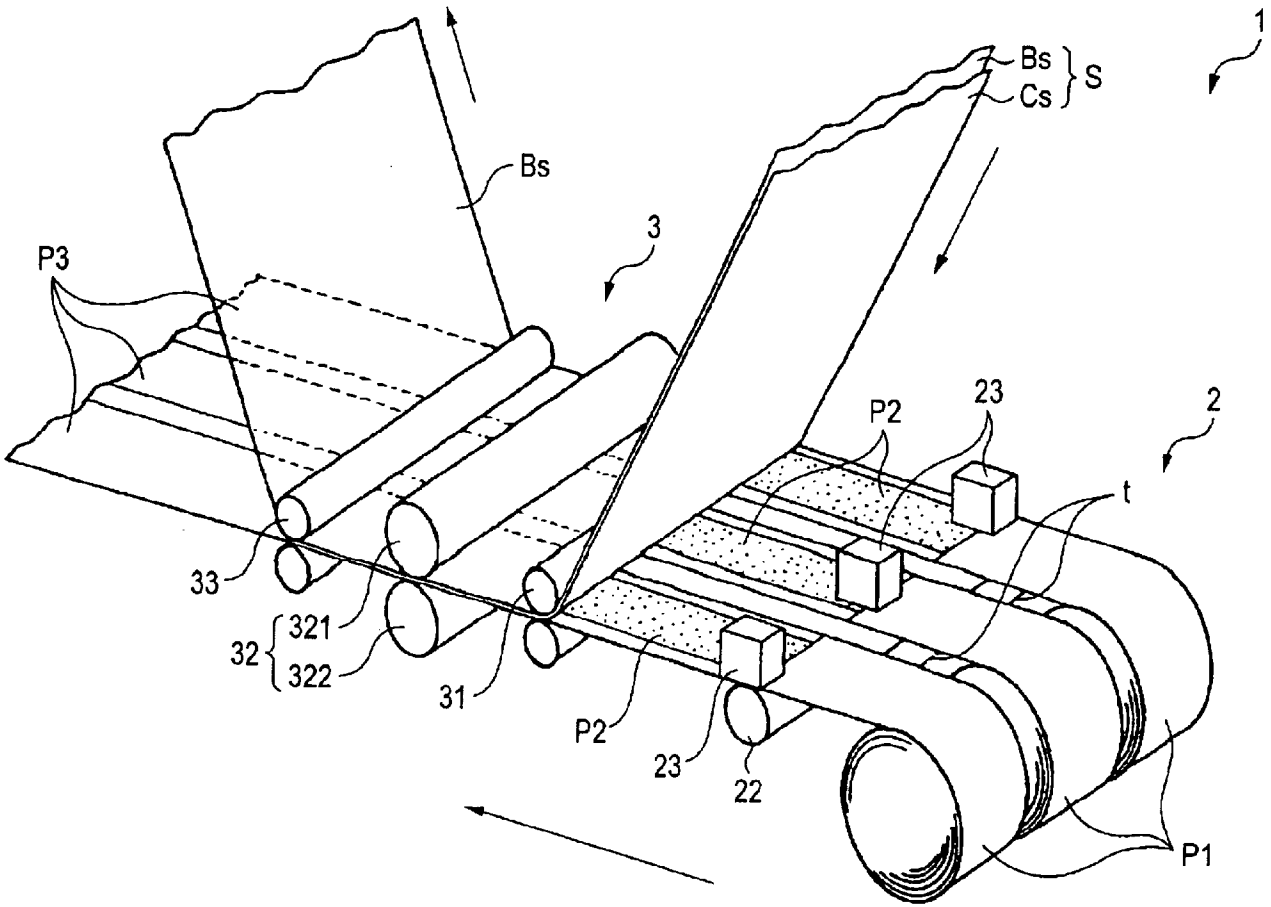
FIG. 2 is a schematic perspective view of the main part of the ink jet record apparatus shown in FIG. 1.

FIG. 1 is a schematic side view of an ink jet record apparatus (printer) 1 of an embodiment of the invention, and FIG. 2 is a schematic perspective view of the main part of the printer 1 shown in FIG. 1. The printer 1 includes an ink jet record section 2 for transporting a plurality of (in the embodiment, three) record media P1, P1, and P1 in parallel with a spacing t and ejecting ink from a plurality of (in the embodiment, three) record heads 23, 23, and 23 for forming images on the record media P1, P1, and P1, and an overcoating device (protective layer formation section) 3 for simultaneously forming protective layers for protecting the images on the images on a plurality of recorded materials P2, P2, and P2 thus produced at the same time. A cutter 4 for cutting a long sheet to a unit length and a discharge tray 5 for storing a plurality of cut sheets cut to the unit length are placed downstream in the transport direction of the record media P1 from the overcoating device 3.

The ink jet record section 2 unreels three record media P1 in roll form wound like a roll by a paper feed roll 21 driven by a motor (not shown) to the position of a platen 22, ejects color inks onto the record sides of the record media P1 from the three record heads 23 for forming any desired ink jet images, and produces three recorded materials P2 at the same time and then transports the recorded materials P2 to the overcoating device (protective layer formation section) 3. Each record head 23 is of cartridge type integral with an ink tank and is mounted on a carriage (not shown). The carriage is held slidably on a guide rail (not shown) placed in a direction orthogonal to the transport direction of the record medial P1 like a usual serial scan ink jet record apparatus, and is joined to a timing belt (not shown) driven by a carriage motor (not shown) for causing the record heads 23 to execute main scanning in the direction.

The record head 23 itself is configured like a record head in this kind of ink jet record apparatus. It includes a plurality of nozzles for ejecting ink, an ink supply passage, an energy applying portion placed in a part of the ink supply passage, an energy generator for generating droplet formation energy made to act on ink in the energy applying portion (the members are not shown), and the like. The energy generator may adopt a technique of using an electromechanical transducer body of a piezoelement, etc., a technique of using an electrothermal conversion body of a heating element, etc., having a heating resistor to heat and eject ink, or the like; any technique can be used.

The overcoating device 3 will be discussed.

The overcoating device 3 includes a transfer sheet supply unit 31 for supplying a transfer sheet S having a transferred layer CS having a width capable of covering a plurality of recorded materials P2, P2, and P2 on a support BS having the same width as the transferred layer CS onto the recorded materials P2, P2, and P2 transported in parallel with the spacing t from the ink jet record section 2 so as to cover the image faces of the recorded materials P2, P2, and P2, a heating and pressing unit 32 for heating and pressing the recorded materials P2, P2, and P2 and the transfer sheet S, and a stripping unit 33 for stripping the support BS from the transfer sheet S after heating and pressing.

The transfer sheet supply unit 31 includes a supply roller 311, the transfer sheet S wound around the supply roller 311, and an angle adjustment roller 312. The supply roller 311 is a roller as the rotation center of the transfer sheet S wound like a roll at the film supply time, and can be rotated in any desired rotation amount and rotation direction by a motor (not shown). The angle adjustment roller 312 is placed movably to some extent up and down and from side to side with the center shaft of the angle adjustment roller 312 maintained in an orthogonal state to the transport direction of the recorded material P2. The angle adjustment roller 312 is moved to an appropriate position as required, whereby the supply angle of the unreeled transfer sheet S to the recorded materials P2 can be adjusted appropriately.

The heating and pressing unit 32 includes a pair of pressing members made up of an upper roller 321 shaped like a cylinder positioned above the transfer sheet S transported from the transfer sheet supply unit 31 and a lower roller 322 shaped like a cylinder opposed to the upper roller 321 for coming in contact with the recorded materials P2, P2, and P2 transported. The upper roller 321 and the upper roller 321 are placed so that the center shafts of the rollers are orthogonal to the transport direction of the recorded materials P2, P2, and P2. The spacing between the upper and lower rollers 321 and 322 can be set as desired and the upper and lower rollers 321 and 322 can be pressed against each other to form a nip part (clamp part) therebetween. The laminate of the recorded materials P2, P2, and P2 and the transfer sheet S produced by the transfer sheet supply unit 31 passes through the nip part and is transported to the following stripping unit 33.

The upper roller 321 and the lower roller 322 are each a heat roller having a heating source such as a heater placed in a hollow cylindrical roller main body. The upper and lower rollers 321 and 322 can be rotated in any desired rotation amount and rotation direction by a motor (not shown) and also serve as transport rollers for transporting the sheet-like substance passing through the nip part. As the formation material of the roller main body, aluminum, carbon steel, stainless steel, etc., can be served. Preferably, the heating source can generate a heating temperature of 80° C. to 120° C., particularly 80° C. to 110° C. from the viewpoint of preventing thermal deformation of the recorded material to be heated (particularly if the recorded material contains resin-coated paper, it is feared that the resin-coated paper will become deformed by heat).

The surface of the upper roller 321 can also be coated with an elastic body layer from the viewpoints of providing the transport torque and the nip width required for transporting a sheet-like substance and pressing the transferred layer CS against the image face in good intimate contact. In this case, preferably the elastic body layer has a thickness of about 5 mm and preferably the elastic body forming the elastic body layer has a hardness of about HA50 according to a measurement method defined by JIS-K6253 (or ASTM-D2240). As the elastic body, preferably silicone rubber, natural rubber, synthetic natural rubber, styrene rubber, butadiene rubber, chloroprene rubber, butyl rubber, nitrile rubber, ethylene propylene rubber, fluororubber, or the like is used. Among them, silicone rubber is excellent in releasability of the roll surface, workability, cost, etc., and is preferably used for the invention.

Figure 3:
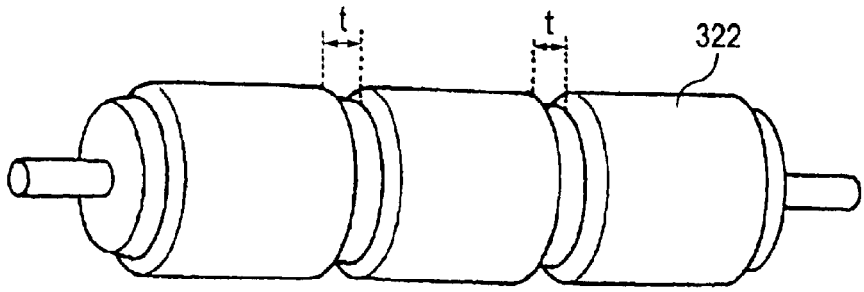
FIG. 3 is a perspective view of a part of a heating and pressing unit (lower roller 322) in the ink jet record apparatus shown in FIG. 1.
Figure 4:
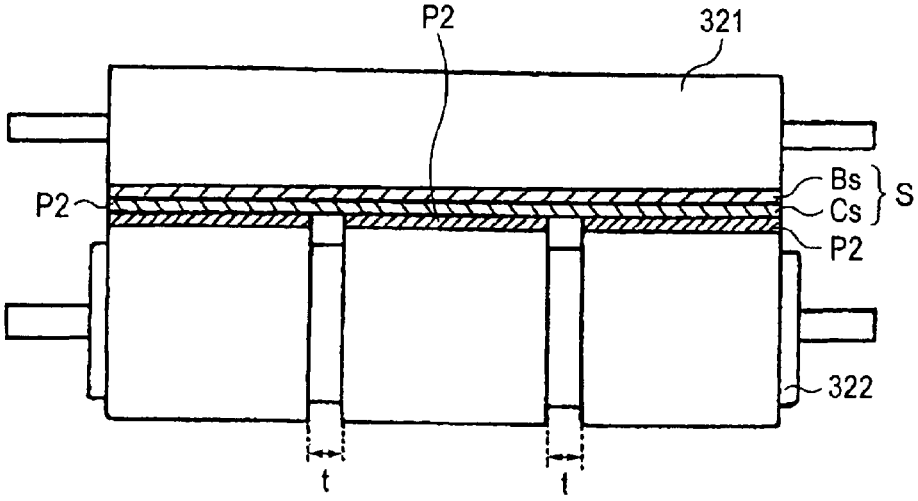
FIG. 4 is a drawing to describe how the heating and pressing unit performs a heating and pressing treatment in the ink jet record apparatus shown in FIG. 1.

FIG. 3 is a perspective view of the lower roller 322. The lower roller 322 is formed on the surface with two grooves corresponding to the spacing t between the recorded materials P2, P2 and P2 and the spacing t between the recorded materials P2, P2 and P2. As such grooves are formed, when the laminate of the recorded materials P2, P2, and P2 and the transfer sheet S passes through the nip part between the upper and lower rollers 321 and 322, the portions of the transferred layer CS of the transfer sheet S corresponding to the spacings t and t (portions not coming in contact with the recorded materials P2) do not come in contact with the surface of the lower roller 322, as shown in FIG. 4, so that various detrimental effects of making the roller dirty, incapability of neat coating edge portions of the recorded materials, and the like, produced as the transferred layer adheres to the roller surface can be prevented. The groove depth may be adjusted appropriately so that such a purpose can be accomplished; preferably the groove depth is 0.2 mm or more, more preferably 0.5 to 20 mm. The groove may be shaped like a letter V or be trapezoidal in cross section as well as angular U-shaped in cross section as in the embodiment (See FIG. 4).

From the viewpoint of preventing heat seal of heated and pressed substances (recorded materials, transfer sheet), a coating of fluorocarbon resin or silicone resin may be applied to the surface of either or both of the upper lower 321 and the lower roller 322 to perform a release treatment or ceramic, chromium, etc., may be thermal-sprayed onto the metal portion of the roller surface.

The stripping unit 33 includes an angle adjustment roll 331 for adjusting the stripping angle of the support BS and a winding roll 332 for winding the stripped support BS. The angle adjustment roll 331 is placed movably to some extent up and down and from side to side like the angle adjustment roller 312, so that the stripping angle can be adjusted appropriately. The winding roll 332 can be rotated in any desired rotation amount and rotation direction by a motor (not shown).

Ink jet record and overcoating treatment of the described printer 1 will be discussed with reference to FIGS. 1 and 2.

To perform ink jet record, the record media P1, P1, and P1 wound like a roll are transported to the position of the platen 22 in parallel with the spacing t, and color inks are ejected from the record heads 23, 23, and 23 based on image information input from a host computer, etc., for forming any desired images. The output image contents can be set for each record medium. A plurality of recorded materials having the same contents can also be produced at the same time; a plurality of recorded materials different in contents can also be produced at the same time. The recorded materials P2, P2, and P2 thus produced are transported to the overcoating device 3 in parallel with the spacing t maintained.

In the overcoating device 3, first the transfer sheet supply unit 31 supplies the transfer sheet S unreeled from the roll state onto the image faces of the recorded materials P2, P2, and P2 being run so that the image faces and the transferred layer CS are opposed to each other. The laminate of the recorded materials P2, P2, and P2 and the transfer sheet S thus put on each other is passed through the nip part between the upper roller 321 and the lower roller 322 pressed against each other (heating and pressing unit 32), and is heated and pressed, as shown in FIG. 4. The heating temperature and pressure (nip pressure between the upper roller 321 and the lower roller 322) at this time may be adjusted appropriately so that the transferred layer CS is pressed against the image faces in good intimate contact considering the formation materials of the transfer sheet and the recorded materials and the like. For example, if the recorded material has an ink acceptance layer consisting mainly of an inorganic pigment of silica, etc., on resin-coated paper, preferably the heating temperature is 80° C. to 120° C., more preferably 80° C. to 110° C. from the viewpoint of preventing thermal deformation of the resin-coated paper. Accordingly, the transfer sheet S is pressed against the image faces of the recorded materials P2, P2, and P2 via the transferred layer CS having adhesion. At this time, the lower roller 322 is formed on the surface with the grooves corresponding to the spacing t between the recorded materials P2, P2 and P2 and the spacing t between the recorded materials P2, P2 and P2 as described above, so that it is not feared that the transferred layer CS will adhere to the lower roller 322.

After the transfer sheet S passes through the heating and pressing unit 32, the temperature lowers and the transfer sheet S is fixedly secured to the image faces. Then, the stripping unit 33 strips the support BS from the transfer sheet S. At this time, the portions of the transferred layer CS corresponding to the spacings t and t are not pressed at the heating and pressing time and thus are stripped off together with the support BS and are wound for collection.

The recorded materials P3, P3, and P3 of long sheets each with a protective layer thus produced are cut to any desired length by the cutters 4, 4, and 4 placed in the vicinity of a discharge port and are discharged onto the discharge tray 5.

The transfer sheet used in the invention will be discussed below:

The transfer sheet has the transferred layer on the support as described above. Letting the adhesive force of the transferred layer to the support after the transferred layer is heated and pressed against the image face of a recorded material be A1 and the adhesive force of the transferred layer to the image face be A2, A2 is set larger than A1 (A2>A1) so that only the transferred layer can be transferred onto the image face. The relation of A2>A1 depends largely on appropriate selection of resin forming the transferred layer, and a silicone release treatment may be applied to the side of the support on which the transferred layer is placed, as required.

Preferably, the support has heat resistance and a polyethylene terephthalate (PET) film, etc., is used preferably. Preferably, the thickness of the support is 4 to 100 $\mu$m, more preferably 6 to 50 $\mu$m. To prevent deposition of dust caused by static electricity, an antistatic treatment may be applied to the support as required.

The transferred layer is transferred onto the image face of a recorded material to form a protective layer, and is made of a resin. Preferably, the resin is a resin which is excellent in intimate contact property with a recorded material (record medium), has high transparency, is hard to change in color by heat or light, and can form a coat excellent in chemical and physical barrier properties. Specifically, a resin having a glass transition temperature (Tg) of 30° C. to 120° C. is preferred. Preferably, a resin is selected so that the surface hardness of the transferred layer becomes pencil hardness 2H or more in a pencil hardness test conforming to JIS-K5600.

As the resin, polyvinyl alcohol (PVA), silanol denatured PVA, polyvinyl pyrrolidone (PVP), carboxymethyl cellulose (CMC), polyvinyl acetal, polyacrylamide, cellulose derivative, casein, gelatin, urethane, acrylic resin, styrene-acrylic resin, polyethylene, vinyl acetate, ethylene-vinyl acetate copolymer (EVA), vinyl chloride-vinyl acetate copolymer, vinyl chloride resin, water alkyd resin, epoxy resin, acetate resin, polyester resin, wax, acrylic styrene, styrene-butadiene rubber (SBR), acrylic ester, etc., can be named. As a water-insoluble resin, a resin commercially available as emulsion can also be used.

The transferred layer may be of a single-layer structure or may be of a multilayer structure of two or more layers different in composition. Preferably, the thickness of the transferred layer is 2 to 30 μm, more preferably 3 to 20 μm. If the thickness is less than 2 μm, it is hard to make the transferred layer uniformly thick and there is a fear of degradation in the image protection effect; if the thickness is more than 30 μm, there is a fear of degradation in transparency. Generally, higher transparency of the transferred layer is preferred; the type of resin to be used is selected appropriately or inorganic fine particles of silica, colloidal silica, etc., are added, etc., whereby the transferred layer can also be matte finished.

To manufacture the transfer sheet, an application liquid having above-mentioned one or more resins dissolved or dispersed in a proper solvent of water, etc., is applied onto the support using a known coating machine and is dried to form the transferred layer. Various additives of a surface active agent, an antifoaming agent, an antistatic agent, an antioxidant, a ultraviolet absorbing agent, a hindered amine base light stabilizer (HALS), etc., can also be added to the application liquid.

The record media and ink that can be applied to the invention are not limited; any record media and ink can be used for the invention if they are usually used for ink jet record. Particularly, if a record medium having an ink acceptance layer, especially a void ink acceptance layer consisting mainly of inorganic ultra fine particle pigment of colloidal silica, vapor-phase method silica, alumina hydrate, γ-aluminum oxide, etc., is used and pigment ink is used, the image quality and image solidity can be still more improved.

Figure 5:
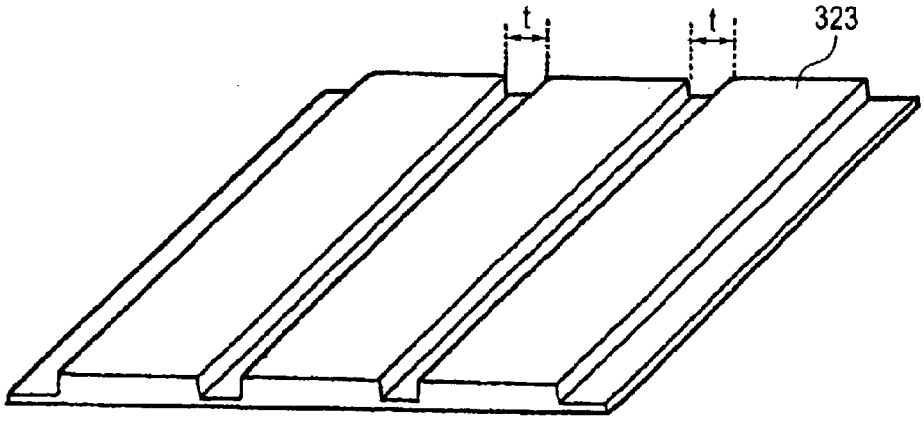
FIG. 5 is a perspective view of a part of another embodiment of heating and pressing unit.

It is to be understood that the invention is not limited to the specific embodiment thereof and the number of recorded materials subjected to overcoating treatment and the specific configurations, shapes, etc., of the components of the apparatus can be changed without departing from the spirit and the scope of the invention. For example, in the embodiment, a pair of cylindrical heat rollers (upper roller 321 and lower roller 322) is adopted as the heating and pressing unit 32, a plate-like body 323 shown in FIG. 5 may be used in place of the lower roller 322 of the roller for coming in contact with a plurality of recorded materials. Like the lower roller 322, the plate-like body 323 is formed on the surface with the grooves corresponding to the spacings t and t. Thus, if, the upper roller 321 and the plate-like body 323 are used in combination as a pair of pressing members (heating and pressing unit), similar advantages to those of the embodiment can be provided. The pressing member for coming in contact with a transfer sheet, of the pressing member pair is not limited to a heat roller like the upper roller 321, and may be a thermal head.

To enhance the stability of the heating temperature of the heating and pressing unit, a preheat roller for previously heating the transfer sheet S and a preheat roller for previously heating the recorded materials P2 can also be placed at any positions before the heating and pressing unit 32 (upper roller 321 and lower roller 322) (upstream in the transport direction of record media).

Figure 6A:
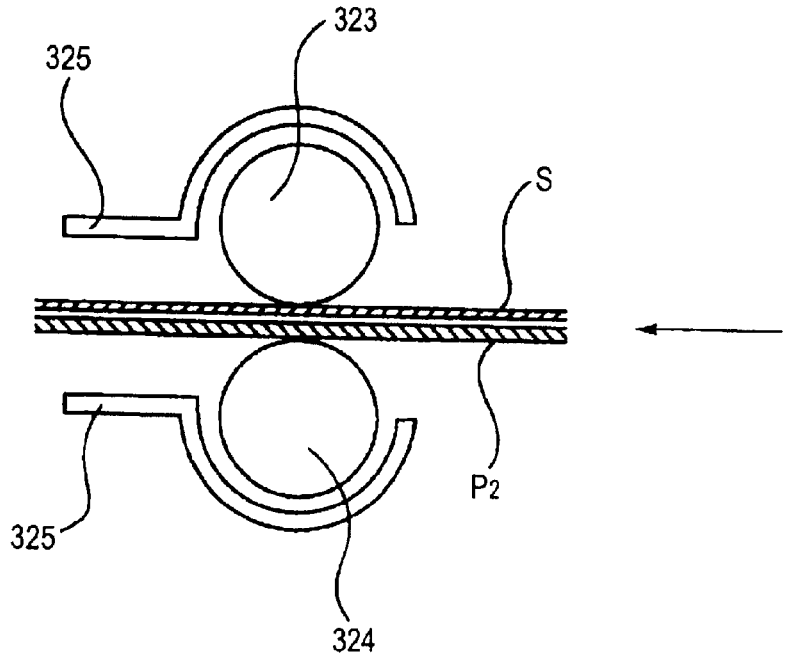
FIGS. 6A and 6B are schematic side views of other embodiments of heating and pressing unit.
Figure 6B:
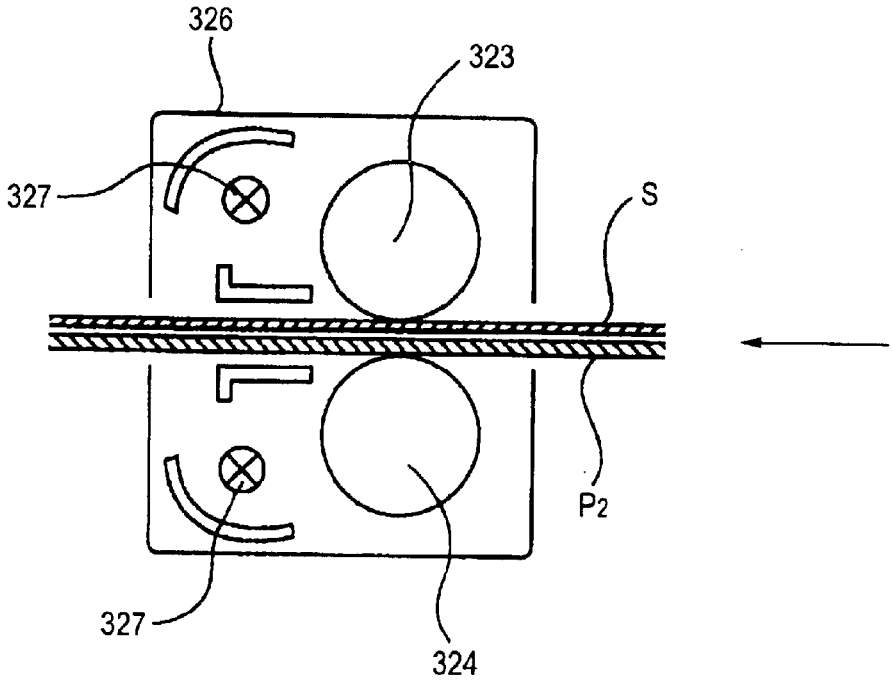

The heating and pressing unit is not limited to the heater roll type as in the embodiment; for example, it may be of cylinder-shell type (also serving as indirect preheating) as shown in FIG. 6A or may be of infrared external heating type as shown in FIG. 6B. The heating and pressing unit of cylinder-shell type includes a usual pair of rollers (a pair of pressing members) 323 and 324 containing no heating source and a heating source (heater) 325 for heating the roller pair and a transport passage just following the roller pair, and is excellent in heat stability. The heating and pressing unit of infrared external heating type includes a pair of rollers 323 and 324, a case 326 for housing the roller pair, and an infrared generator 327 housed in the case 326 together with the roller pair, and is excellent in rise in heating temperature and heating performance. For example, a silica tube, a halogen heater, etc., can be named as the infrared generator 327.

The record head in the ink jet record apparatus of the invention may be not only of cartridge type integral with an ink tank as in the embodiment, but also of type wherein ink is supplied through a tube, etc., from an ink tank separate from the record head.

According to the invention, an overcoating treatment can be applied efficiently to the recorded materials formed with images according to the ink jet method, and the recorded materials each with a protective layer having high image quality and high image solidity comparative to a film photo can be provided at low cost. The overcoating device of the invention is also excellent in maintainability as the transferred layer is not deposited on the surface of the pressing member after the heating and pressing treatment.

What is claimed is:

1. An overcoating device for transporting a plurality of recorded materials formed with images according to an ink jet method in parallel with spacing and overcoating each of image faces of the recorded materials with a protective layer for protecting the image, said overcoating device comprising:

a transfer sheet supply unit for supplying a transfer sheet, having a transfer layer on a support, that has a width that covers the recorded materials, which are transported in parallel with the spacing, so as to cover the image faces of the recorded materials;

a heating and pressing unit for heating and pressing the recorded materials and the transfer sheet; and a stripping unit for stripping the support from the transfer sheet after heating and pressing, wherein said heating and pressing unit comprises a pair of pressing members for allowing the recorded materials and the transfer sheet to pass through a nip part between the paired pressing members and when the recorded materials and the transfer sheet pass through the nip part, a portion of the transferred layer of the transfer sheet corresponding to the spacing does not contact the pressing member that contacts the recorded materials.

2. The overcoating device as claimed in claim 1 wherein the pressing member that contacts the recorded materials has a groove, formed in its surface, corresponding to the spacing.

3. The overcoating device as claimed in claim 1 wherein the pressing member pair is a pair of rollers and a roller that contacts the recorded materials has a groove, formed in its surface, corresponding to the spacing.

4. The overcoating device as claimed in claim 1 wherein the pressing member pair is a roller and a plate-like body and the plate-like body that contacts the recorded materials has a groove, formed in its surface, corresponding to the spacing.

5. The overcoating device as claimed in claim 2 wherein the groove has a depth 0.2 mm or more.

6. An ink jet record apparatus comprising an overcoating device comprising:

a plurality of record media that are transported in parallel with spacing, wherein ink is ejected from a plurality of record heads for forming images on the plurality of record media to prepare recorded materials, and then said overcoating device overcoats each of image faces of the recorded materials with a protective layer for protecting the image;

a transfer sheet supply unit for supplying a transfer sheets, having a transfer layer on a support, that has a width that covers the plurality of recorded materials with spacing, so as to cover image faces of the recorded materials;

a heating and pressing unit for heating and pressing the recorded materials and the transfer sheet; and a stripping unit for stripping the support from the transfer sheet after heating and pressing, wherein the heating and pressing unit allows the recorded materials and the transfer sheet to pass through a nip part between paired pressing members and when the recorded materials and the transfer sheet pass through the nip part, a portion of the transfer layer of the transfer sheet corresponding to the spacing does not contact the pressing member that contacts the recorded materials.

* * * * *